US011851943B2

(12) United States Patent
Wang

(10) Patent No.: US 11,851,943 B2
(45) Date of Patent: Dec. 26, 2023

(54) PASSAGE BARRIER

(71) Applicant: ABORDER PRODUCTS, INC., Irving, TX (US)

(72) Inventor: Xuzhong Wang, Shenzen (CN)

(73) Assignee: ABORDER PRODUCTS, INC., Irving, TX (US)

( * ) Notice: Subject to any disclaimer, the term of this patent is extended or adjusted under 35 U.S.C. 154(b) by 0 days.

(21) Appl. No.: 17/581,607

(22) Filed: Jan. 21, 2022

(65) Prior Publication Data

US 2022/0268095 A1 Aug. 25, 2022

(30) Foreign Application Priority Data

Feb. 19, 2021 (CN) ..... 202120376752.3
Nov. 5, 2021 (CN) ..... 202122704534.0

(51) Int. Cl.
*E06B 9/01* (2006.01)
*E06B 9/04* (2006.01)
*E06B 9/00* (2006.01)

(52) U.S. Cl.
CPC ..... *E06B 9/04* (2013.01); *E06B 9/01* (2013.01); *E06B 2009/002* (2013.01)

(58) Field of Classification Search
CPC ..... E06B 9/04; E06B 9/01; E06B 2009/002; E06B 9/02; F16B 37/085
USPC ..... 411/417, 418
See application file for complete search history.

(56) References Cited

U.S. PATENT DOCUMENTS 3,842,977 A * 10/1974 Hollander ..... A45C 3/00 206/407
4,635,891 A * 1/1987 McDonough ..... G01B 5/0002 411/417
7,131,235 B2 11/2006 Hicks
7,871,219 B2 * 1/2011 Maruyama ..... F16B 35/005 411/315
7,975,431 B2 * 7/2011 Flannery ..... E06B 7/32
8,313,071 B2 * 11/2012 Huang ..... F16M 11/125 248/276.1
9,874,055 B1 1/2018 Flannery et al.
11,072,973 B2 * 7/2021 Flannery ..... E06B 9/04
(Continued)

FOREIGN PATENT DOCUMENTS

CN 204591933 U 8/2015
CN 207848164 U 9/2018
WO WO-02/099238 A1 12/2002

OTHER PUBLICATIONS

European Patent Application No. 22163839.8, Extended European Search Report, dated Oct. 6, 2022.

*Primary Examiner* — Janet M Wilkens
*Assistant Examiner* — Susan M. Heschel
(74) *Attorney, Agent, or Firm* — KLEMCHUK PLLC

(57) ABSTRACT

A passage barrier includes a frame and a gate engaged in the frame. The four corners of the frame are provided with mounting holes for receiving pressurized fasteners. An adjustment member can be rotated on a rod of the pressurized fastener. The mounting hole and the rod are designed so that the rod can only slide in the mounting hole but cannot rotate. In the installation process, a user is reminded not to press the frame on both sides of the passage by rotating the rod of the pressurized fastener, but to press the frame on both sides of the passage by rotating the adjustment member, so that the user can quickly find the correct the installation method.

18 Claims, 8 Drawing Sheets

(56) References Cited

U.S. PATENT DOCUMENTS

| | | | | |
|---|---|---|---|---|
| 2013/0202381 | A1* | 8/2013 | Frenken | F16B 39/28<br>411/433 |
| 2018/0112457 | A1* | 4/2018 | Raffi | E05C 19/06 |
| 2020/0355024 | A1* | 11/2020 | Katcher | E06B 9/78 |
| 2021/0172222 | A1* | 6/2021 | Wang | E05C 9/02 |

* cited by examiner

PASSAGE BARRIER

FIELD OF THE INVENTION

The present invention relates to generally to barriers, and more specifically to barriers that are convenient for quickly finding a correct installation method.

BACKGROUND OF THE INVENTION

Often, in order to prevent children or pets from leaving a room, or entering/exiting a specific place, a removable passage barrier is installed between two locations, such as between two door jambs of a doorway. With internal pressure generated by pressurized fasteners, the passage barrier can be installed between two locations and a swinging gate can be opened and closed throughout the day. However, in current passage barriers, because a screw of the pressurized fastener can be rotated in the mounting hole, the installer may mistakenly think that rotating the screw applies pressure to the door jambs, which may prevent a complete installation. As a result, consumers may mistakenly believe that the product has been damaged.

SUMMARY OF THE INVENTION

A passage barrier facilitates a complete installation by guiding the installer to quickly find the correct installation method.

In a first aspect, a passage barrier includes: a) a substantially right-angled U-shaped frame having four corners, with each of the corners having an outer end, and the outer end having a mounting hole; b) a gate pivotally engaged in the frame; c) a pressurized fastener corresponding to the mounting hole, the pressurized fastener including: i) a screw having a head and a rod, the rod being slidably received in the mounting hole; ii) an adjustment member having a through hole with an internal thread, the through hole being drilled on the rod and rotatable around a rotation axis; iii) wherein the rod has a plurality of engaging parts and a plurality of non-engaging parts on its outer surface, the engaging parts and the non-engaging parts being alternately connected, the engaging parts being located on a circumferential surface of a virtual cylinder with the rotation axis as a cylinder axis and having an external thread engaged with the internal thread, the non-engaging parts being located within the circumferential surface of a virtual cylinder so as not to be engaged with the internal thread; and d) a cross-sectional shape of the mounting hole is substantially the same as the cross-sectional shape of the rod, and the cross-sectional size of the mounting hole is slightly larger than the cross-sectional size of the rod, so that the rod can only be slid in the mounting hole and cannot be rotated.

In a second aspect, a passage barrier includes: a) a substantially right-angled U-shaped frame having four corners, with each of the corners having an outer end, and the outer end having a mounting hole; b) a gate pivotally engaged in the frame; c) a pressurized fastener corresponding to the mounting hole, the pressurized fastener including: i) a screw having a head and a rod, the rod being slidably received in the mounting hole; ii) an adjustment member having a through hole with an internal thread, the through hole being drilled on the rod and rotatable around a rotation axis; iii) wherein the rod has two engaging parts and two non-engaging parts on its outer surface, the engaging parts and the non-engaging parts being alternately connected and dividing lines are located on a circumferential surface of a virtual cylinder with the rotation axis as cylinder axis, the engaging parts being located on the circumferential surface and having an external thread engaged with the internal thread, the non-engaging parts are two opposite sides of a quadrangular prism with the dividing lines as edges; and d) wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

In a third aspect, a passage barrier includes: a) a substantially right-angled U-shaped frame having four corners, with each of the corners having an outer end, and the outer end having a mounting hole; b) a gate pivotally engaged in the frame; c) a pressurized fastener corresponding to the mounting hole, the pressurized fastener including: i) a screw having a head and a rod, the rod being slidably received in the mounting hole; ii) an adjustment member having a through hole with an internal thread, the through hole being drilled on the rod and rotatable around a rotation axis; iii) wherein the rod has an engaging part and a non-engaging part on its outer surface, the engaging part and the non-engaging part being connected and dividing lines are located on a circumferential surface of a virtual cylinder with the rotation axis as cylinder axis, the engaging part being located on the circumferential surface corresponding to a major arc of the virtual cylinder and having an external thread engaged with the internal thread, the non-engaging part being located within the circumferential surface of the virtual cylinder so as not to be engaged with the internal thread; and d) wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

In a fourth aspect, a passage barrier includes: a) a substantially right-angled U-shaped frame having four corners, with each of the corners having an outer end, and the outer end having a mounting hole; b) a gate pivotally engaged in the frame; c) a pressurized fastener corresponding to the mounting hole, the pressurized fastener including: i) a screw having a head and a rod, the rod being slidably received in the mounting hole; ii) an adjustment member having a through hole with an internal thread, the through hole being drilled on the rod and rotatable around a rotation axis; iii) wherein the rod has a plurality of engaging threaded parts and a plurality of non-engaging threaded parts on its outer surface, the engaging threaded parts and the non-engaging threaded parts being alternately and substantially smoothly connected and their threads are continuous and dividing lines are located on a circumferential surface of a virtual cylinder with the rotation axis as cylinder axis, the engaging threaded parts being located on the circumferential surface and having an external thread engaged with the internal thread, the non-engaging threaded parts being located within the circumferential surface of the virtual cylinder so as not to be engaged with the internal thread; and d) wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

In a fifth aspect, a passage barrier includes: a) a substantially right-angled U-shaped frame having four corners, with each of the corners having an outer end, and the outer end having a mounting hole; b) a gate pivotally engaged in the frame; c) a pressurized fastener corresponding to the mounting hole, the pressurized fastener including: i) a screw having a head and a rod, the rod being slidably received in the mounting hole; ii) an adjustment member having a through hole with an internal thread, the through hole being drilled on the rod and rotatable around a rotation axis; iii) wherein the rod has an engaging part and a non-engaging part on its outer surface, the engaging part being located on a circumferential surface of a virtual cylinder with the rotation axis as a cylinder axis and having an external thread engaged with the internal thread, wherein the adjustment member can be rotated on the rod substantially without shaking, the non-engaging part being located within the circumferential surface of the virtual cylinder so as not to be engaged with the internal thread; and d) wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

BRIEF DESCRIPTION OF THE DRAWINGS

While the specification concludes with claims particularly pointing out and distinctly claiming the subject matter, which is regarded as forming the present invention, the invention will be better understood from the following description taken in conjunction with the accompanying drawings.

DETAILED DESCRIPTION

In order to give clearer description of the technical problems to be solved, and the technical solutions and beneficial effects of the fasteners and passage barriers described therein, the details will be further described in below with reference to the accompanying figures. It should be understood that the specific embodiments described here are only used to explain the disclosed fasteners and passage barriers, and the drawings and specific embodiments described herein are not intended to limit the scope of the disclosure. Rather, the scope of the disclosure is limited only by the claims set forth herein.

When an element is referred to as being "fixed to" or "disposed on" another element, it can be directly connected to the other element or indirectly connected to that element. When an element is said to be "connected to" another element, it can be directly connected to the other element or indirectly connected to that element.

The terms "length", "width", "upper", "lower", "front", "rear", "left", "right", "vertical", "horizontal", "top", "bottom", "inner", "outer" and other indications of the orientation or positional relationship are based on the orientation or positional relationship shown in the figures, and are only for the convenience of describing the fasteners and passage barriers, and simplifying the description, rather than indicating or implying that the device or element must have a specific orientation, be constructed and operated in a specific orientation.

The terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description, "multiple" means two or more than two, unless otherwise specifically defined.

Figure 1:
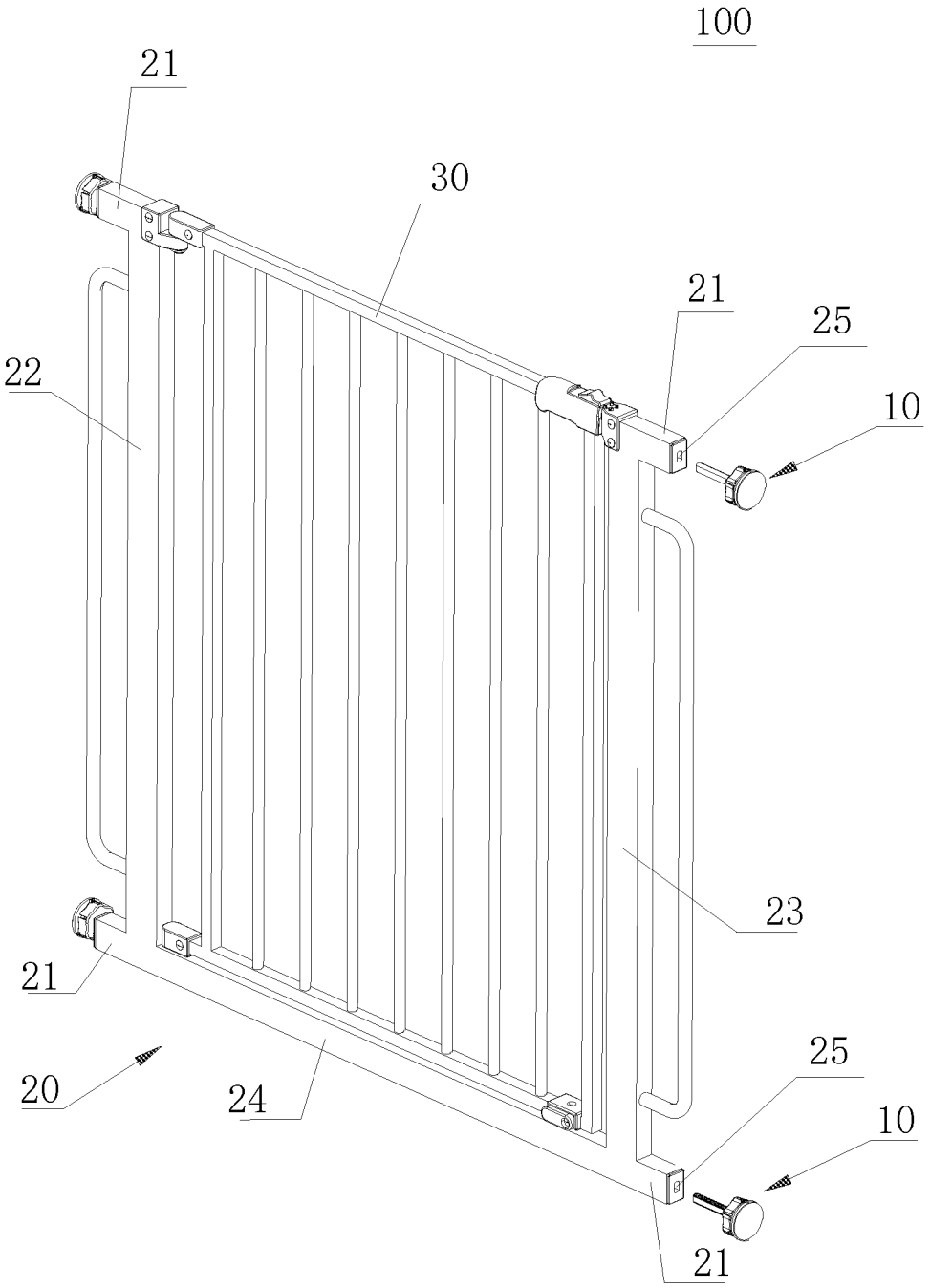
FIG. 1 is a perspective view of a base structure of a passage barrier where a pressurized fastener is illustrated, but an alternative fastener may be furnished by any one of the pressurized fasteners illustrated in FIGS. 4, 5, 7, 9, 10, 12, and a mounting hole, which also is illustrated in FIG. 1, but an alternative mounting hole may be furnished by any one of the mounting holes illustrated in FIGS. 6, 8, 11, 14, corresponding to the pressurized fastener.
Figure 2:
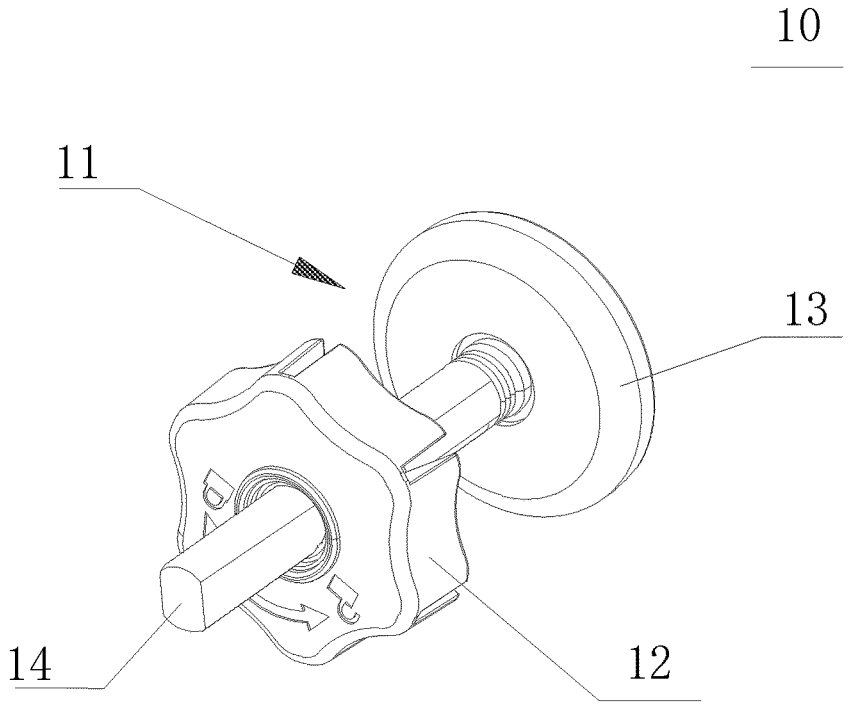
FIG. 2 is a perspective view of the pressurized fastener for the passage barrier of FIG. 1.
Figure 3:
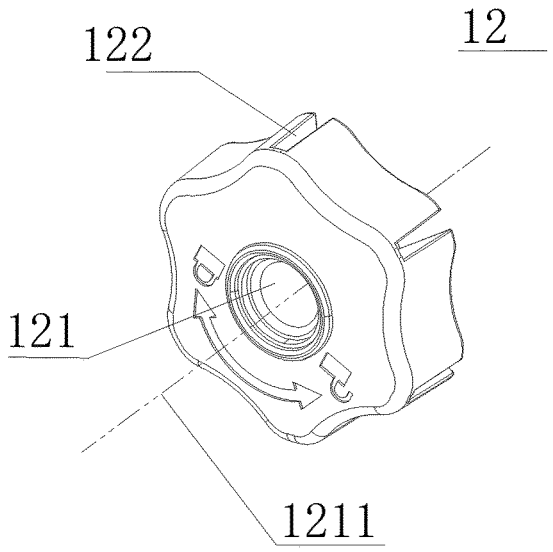
FIG. 3 is a perspective view of an adjustment member for the pressurized fastener of FIG. 2.

Turning to FIGS. 1, 2 and 3, the passage barrier is designated by the reference numeral 100. The passage barrier 100 generally includes a substantially "right-angled U-shaped" frame 20 comprising a first side frame 22, a second side frame 23, and a horizontal side frame 24, and a door 30 that is pivotally engaged in the frame 20. The frame 20 has four corners, with each of the corners having an outer end 21, and the outer ends 21 having a mounting hole 25 for slidingly receiving a pressurized fastener 10. The pressurized fastener 10 comprises a screw 11, which includes a disk-shaped head 13 fixed at an end and a rod 14 with an external thread. The head 13 is configured to abut against, and apply pressure to, walls or door jambs on both sides of a passage, and the rod 14 is slidably received in the mounting hole 25. The pressurized fastener 10 comprises an adjustment member 12 which has a through hole 121 with an internal thread. The through hole 121 accepts part of the rod 14 and is rotatable around a rotation axis 1211. The external thread on the rod 14 is engaged with the internal thread of the through hole 121. In use a hand or a tool turns the adjustment member 12 toward the outer end 21 and makes contact with the outer end 21, and when the adjustment member 12 continues to travel in the direction of the outer end 21, this travel will cause the screw 11 to slide outward, and causes the head 13 exert pressure on the walls or door jambs on both sides of the passage.

The adjustment member 12 may optionally include a plurality of evenly distributed notches 122, and the notches 122 may be used for accepting a wrench or other tools. The wrench or other tools may be detachably inserted into any one of the notches 122 and may be used to drive the adjustment member 12 to rotate by applying force. While one embodiment of the pressurized fastener 10 is illustrated in FIGS. 1 and 2, other embodiments, such as any one of the pressurized fasteners shown in FIGS. 4, 5, 7, 9, 10, 12, may be substituted and while one embodiment of the mounting hole is illustrated in FIG. 1. Other embodiments of the mounting hole may be substituted, for example any one of the mounting holes shown in FIGS. 6, 8, 11, 14, which correspond to a chosen pressurized fastener.

Figure 4:
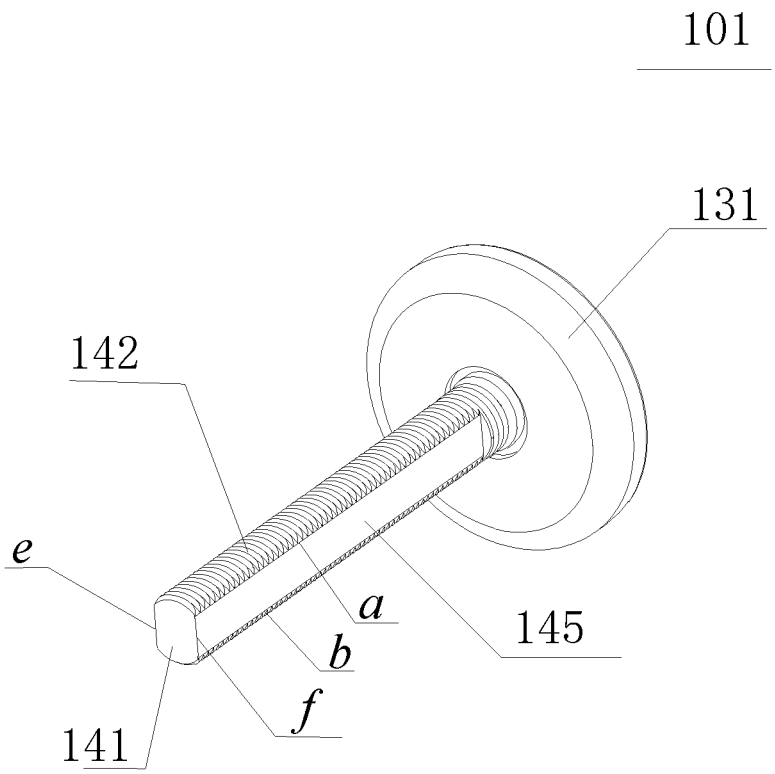
FIG. 4 is a perspective view of a screw of the pressurized fastener of FIG. 2.
Figure 5:
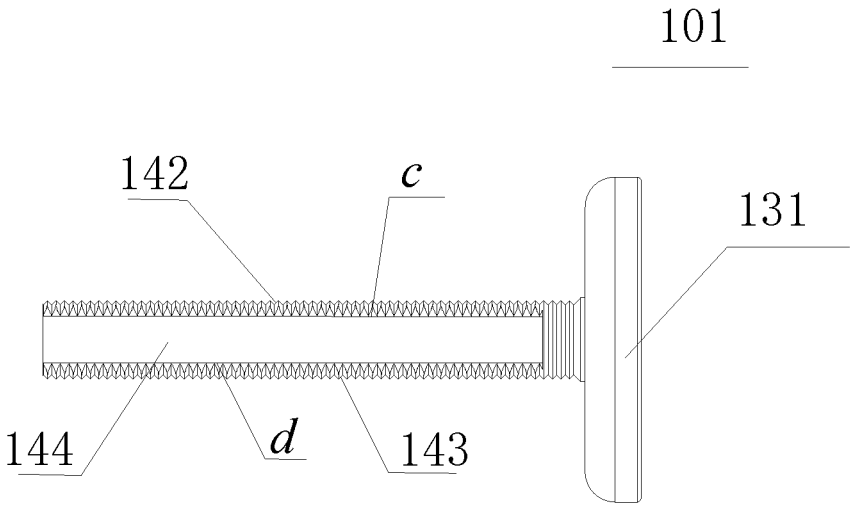
FIG. 5 is a side view of the screw of FIG. 4.
Figure 6:
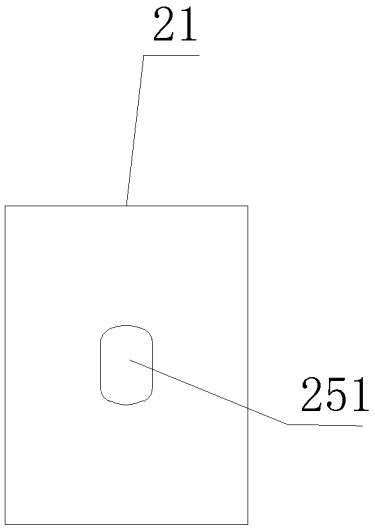
FIG. 6 is a front view of a mounting hole for the pressurized fastener of FIG. 2.

FIGS. 4 and 5 show another embodiment of a pressurized fastener 101 that may be used in the base structure of FIG. 1 (the illustration of the adjustment member is omitted because the adjustment member is the same as that in the base structure) and FIG. 6 shows a mounting hole 251. The pressurized fastener 101 includes a head 131 and a rod 141. The outer surface of the rod 141 includes a first threaded part 142, a second threaded part 143, a first non-threaded part 144 and a second non-threaded part 145. Among them, the threaded part and the non-threaded part are alternately connected, and a dividing line between the threaded part and the non-threaded part lies on a circumferential surface of a virtual cylinder with the rotation axis of the adjustment member as the cylinder axis. Among them, the first threaded part 142 and the second threaded part 143 are located on the circumferential surface of the virtual cylinder, and the first non-threaded part 144 and the second non-threaded part 145 are the opposite sides of a regular quadrangle prism with edges (such as edges a, b, c and d in FIGS. 4 and 5) arranged on the circumferential surface of the virtual cylinder, and edges a, b, c and d are the dividing lines between the threaded part and the non-threaded part. It should be understood that in this embodiment, the side lengths of opposite sides (e.g., side e and side f in FIG. 4) of the bottom surface of the regular quadrangle prism are not limited, and different sizes can be adopted as needed, and the selected sizes determine the area sizes of the first threaded part 142 and the second threaded part 143. For example, the longer the side e and the side f the smaller the area of the first threaded part 142 and the second threaded part 143, otherwise, the larger the area.

As shown in FIG. 6, a cross-sectional shape of the mounting hole 251 is substantially the same as that of the rod 141, but the size is slightly larger than that of the rod 141 and the inner surface of the mounting hole 251 is unthreaded, so that the rod 141 can slide in the mounting hole 251 and can be prevented from rotating in the mounting hole 251.

Figure 7:
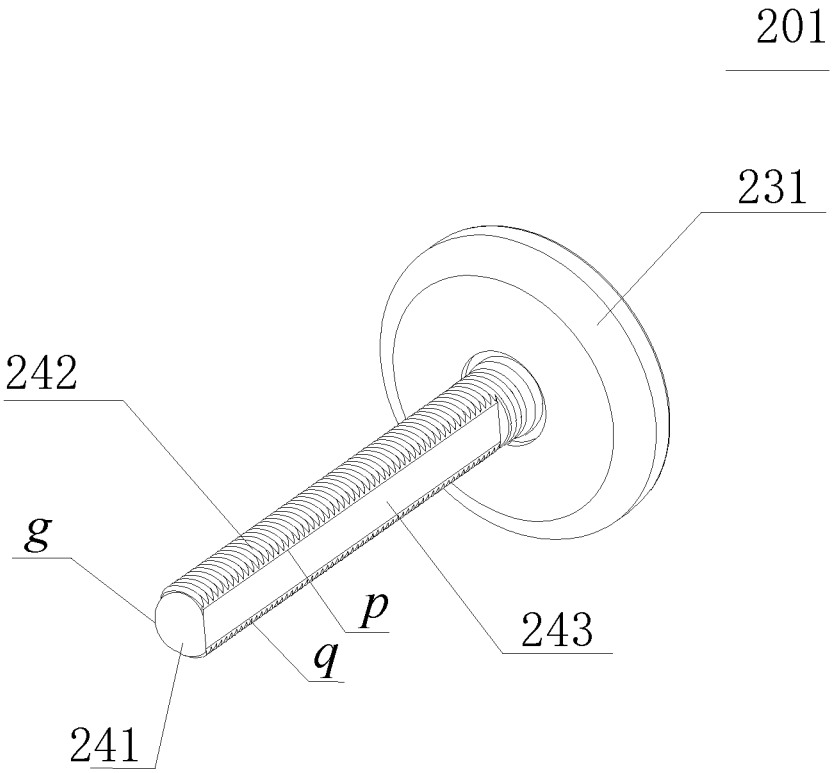
FIG. 7 is a perspective view of a screw of an alternate embodiment of a pressurized fastener.
Figure 8:
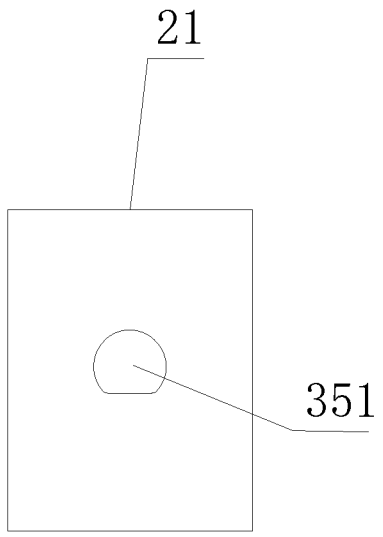
FIG. 8 is a front view of an alternative embodiment of a mounting hole for the pressurized fastener of FIG. 7.

FIG. 7 shows another embodiment of a pressurized fastener 201 and FIG. 8 shows a mounting hole 351. The pressurized fastener 201 includes a head 231 and a rod 241. The outer surface of the rod 241 includes a threaded part 242 and a non-threaded part 243. The dividing line between the threaded part and the non-threaded part lies on a circumferential surface of a virtual cylinder with the rotation axis of the adjustment member as the cylinder axis, wherein the threaded part 242 lies on the circumferential surface corresponding to a major arc of the virtual cylinder, the non-threaded part 243 is a plane connecting two edges of the threaded part 242 (such as edge p and edge q in FIG. 7), and edge p and edge q are the dividing lines between the threaded part and the non-threaded part. It should be understood that in this embodiment, the length of the major arc (such as the major arc g in FIG. 7) is not limited (unless unrealistic), and different sizes can be adopted as needed, and the selected size determines the area of the threaded portion 242. For example, the longer the major arc g is, the larger the area of the threaded part 242 is, and vice versa. It is not recommended that the threaded part 242 is lies on a circumferential surface corresponding to a semi-circular arc or a minor arc in this embodiment, because this will cause the adjusting part 12 to shake in the mounting hole 351 when rotating, resulting in that the internal thread of the adjustment member cannot well engage the external thread of the threaded part 242. It should be understood that the non-threaded part 243 can also be an arc surface or other irregular surface which connects two edges of the threaded part 242 (such as edge p and edge q in FIG. 7) and is within the circumferential surface of the virtual cylinder.

As shown in FIG. 8, a cross-sectional shape of the mounting hole 351 is substantially the same as that of the rod 241, but the size is slightly larger than that of the rod 241 and the inner surface of the mounting hole 351 is unthreaded, so that the rod 241 can slide in the mounting hole 351 and can be prevented from rotating in the mounting hole 351.

Figure 9:
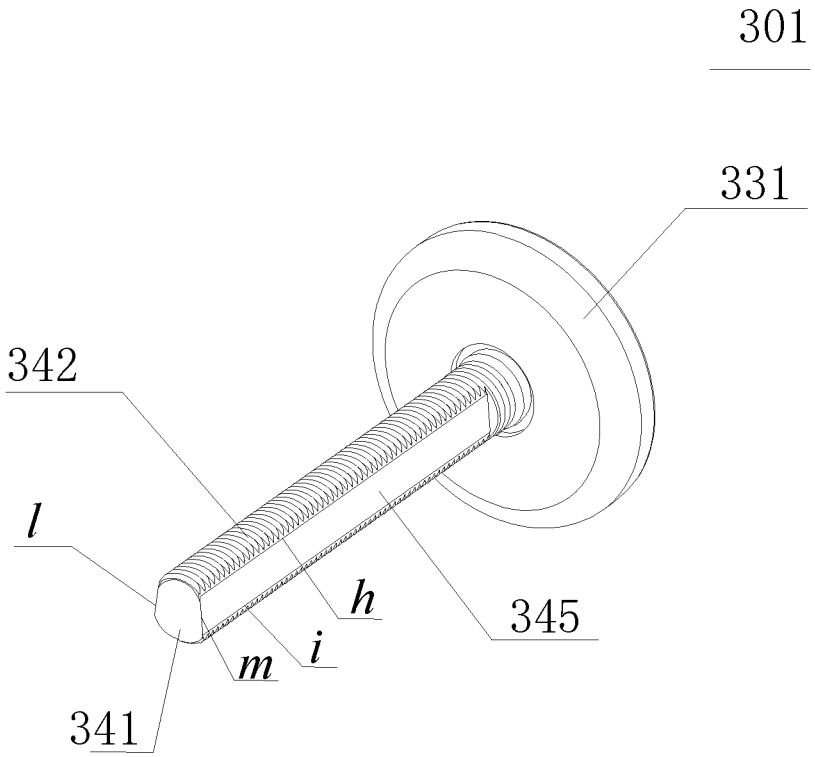
FIG. 9 is a perspective view of another alternate embodiment of a screw of a pressurized fastener.
Figure 10:
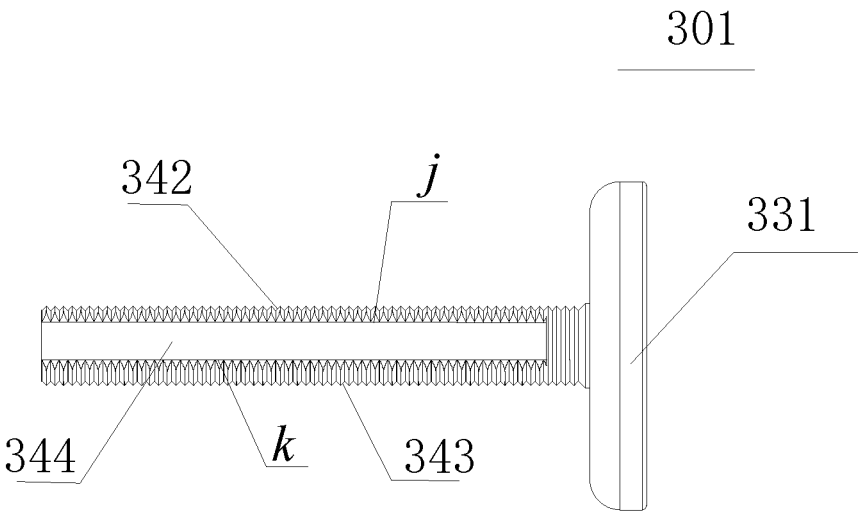
FIG. 10 is a side view of the screw of FIG. 9.
Figure 11:
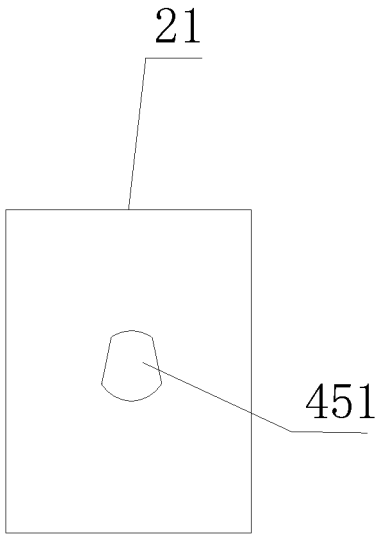
FIG. 11 is a front view of another alternative embodiment of a mounting hole for the pressurized fastener of FIG. 9.

FIGS. 9 and 10 show another embodiment of a pressurized fastener 301 and FIG. 11 shows a mounting hole 451. The pressurized fastener 301 includes a head 331 and a rod 341. The outer surface of the rod 341 includes a first threaded part 342, a second threaded part 343, a first non-threaded part 344 and a fourth non-threaded part 345. Among them, the threaded part and the non-threaded part are alternately arranged, and the dividing line between the threaded part and the non-threaded part is located on the circumferential surface of a virtual cylinder with the rotation axis of the adjusting member as the cylinder axis. Among them, the first threaded part 342 and the second threaded part 343 are located on the circumferential surface of the virtual cylinder, and the first non-threaded part 344 and the second non-threaded part 345 are two opposite sides of a straight prism whose edges (such as edge h, edge i, edge j and edge k in FIGS. 9 and 10) are arranged on the virtual cylindrical surface and the bottom surface is trapezoidal, which can be the sides corresponding to two waists of a trapezoid or the sides corresponding to the upper and lower bottoms of the trapezoid. It should be understood that in this embodiment, the lengths of two opposite waists (such as waist 1 and waist m in FIG. 9) at the bottom of the straight prism are not limited, and different lengths can be adopted as needed. The selected lengths determine the area sizes of the first threaded part 342 and the second threaded part 343. For example, the larger the lengths of waist 1 and waist m, the smaller the area of at least one of the first threaded part 342 and the second threaded part 343, and vice versa. It is not recommended that the upper bottom and the lower bottom of the trapezoid be located on the same side of the cylinder axis, because this will cause the adjusting member to shake in the mounting hole 451 when rotating, resulting in that the internal thread of the adjusting member cannot well engage the external thread of the first threaded part 342 and the second threaded part 343.

As shown in FIG. 11, a cross-sectional shape of the mounting hole 451 is substantially the same as that of the rod 341, but the size is slightly larger than that of the rod 341 and the inner surface of the mounting hole 451 is unthreaded, so that the rod 341 can slide in the mounting hole 451 and can be prevented from rotating in the mounting hole 451.

Figure 12:
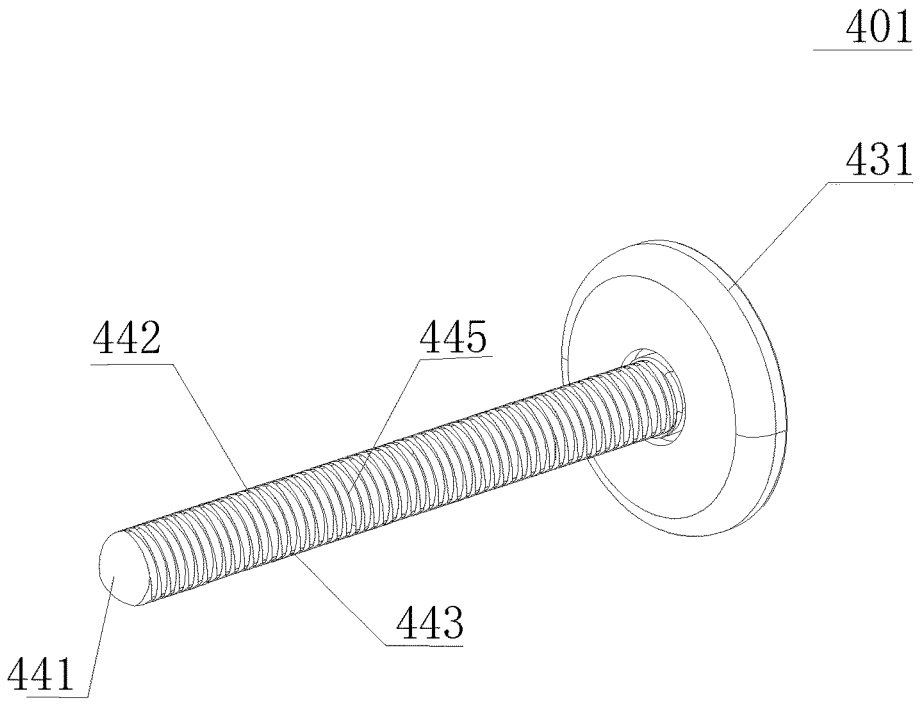
FIG. 12 is a perspective view of a screw of another alternate embodiment of a pressurized fastener.
Figure 13:
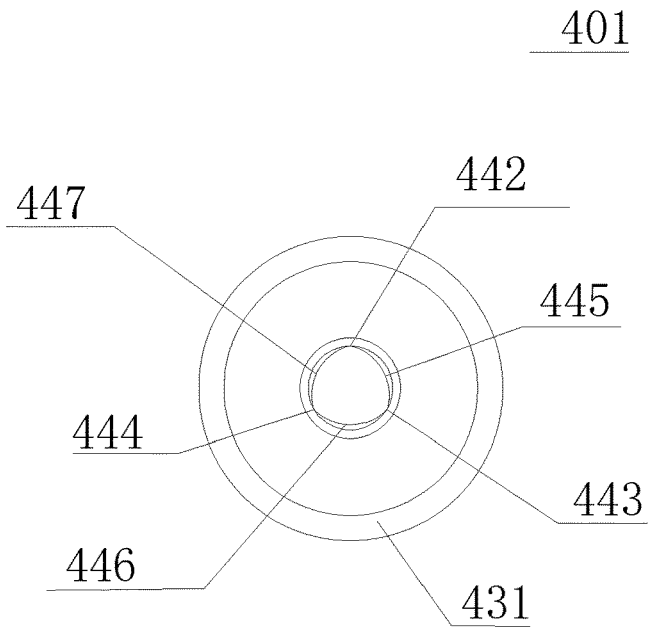
FIG. 13 is a front view of the screw of FIG. 12.
Figure 14:
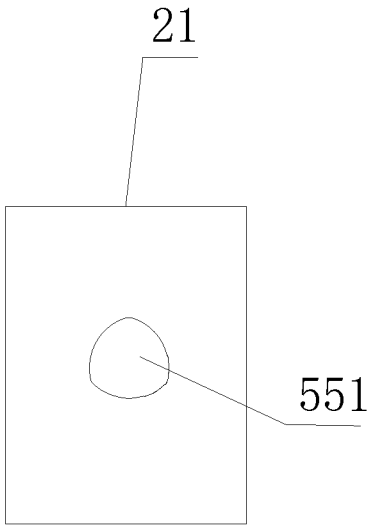
FIG. 14 is a front view of another alternate embodiment of a mounting hole for the pressurized fastener of FIG. 12.

FIGS. 12 and 13 show another embodiment of a pressurized fastener 401 and FIG. 14 shows a mounting hole 551. The pressurized fastener 401 includes a head 431 and a rod 441. The outer surface of the rod 441 includes a first engaging threaded part 442, a second engaging threaded part 443, a third engaging threaded part 444, a first non-engaging threaded part 445, a second non-engaging threaded part 446 and a third non-engaging threaded part 447. Among them, the thread of the engaging threaded parts can be engaged with the internal thread of the adjustment member, while the thread of the non-engaging threaded parts cannot be engaged with the internal thread of the adjustment member. Engaging threaded parts and non-engaging threaded parts are alternately arranged, and the dividing line between the engaging threaded part and non-engaging threaded part is located on the circumferential surface of a virtual cylinder with the rotation axis of the adjustment member as the cylinder axis. Among them, the first engaging threaded part 442, the second engaging threaded part 443 and the third engaging threaded part 444 are annularly arranged on the circumferential surface of the virtual cylinder, and the first non-engaging threaded part 445, the second non-engaging threaded part 446 and the third non-engaging threaded part 447 are convex circular arc surfaces which are respectively connected between the two engaging threaded parts and are located in the circumferential surface of the virtual cylinder, so that the engaging threaded part and the non-engaging threaded part make a substantially smooth transition connection, and their threads are continuous. It can be understood that the number of engaging and non-engaging threaded parts can be selected according to requirements, for example, it can be two engaging threaded parts and two non-engaging threaded parts. It should be understood that the number of engaging threaded parts and non-engaging threaded parts can also be four or five. However, the number cannot be increased indefinitely, and the selected number should make the cross section of the rod 441 appear obviously non-circular. It can be understood that the above-mentioned non-engaging threaded part can also be replaced by a flat or convex arc surface or concave arc surface or other irregular surface non-threaded part.

As shown in FIG. 14, a cross-sectional shape of the mounting hole 551 is substantially the same as that of the rod 441, but the size is slightly larger than that of the rod 441 and the inner surface of the mounting hole 551 is unthreaded, so that the rod 441 can slide in the mounting hole 551 and can be prevented from rotating in the mounting hole 551.

Some of the features in the above embodiments can be combined to form new embodiments, for example, in one embodiment, some of the non-engaging parts can be flat, some of them arc-shaped, or some of the non-engaging parts can have threads, some of them have no threads, and so on.

The above embodiments improve the pressurized fastener and the mounting hole, so that the pressurized fastener can slide in the mounting hole but cannot rotate, thus preventing the installer from mistaking the installation operation by screwing the pressurized fastener when installing the passage barrier, thus leading the installer to give up screwing the pressurized fastener and install by rotating the adjustment member, and facilitating the installer to quickly find the correct installation method.

The above descriptions are only preferred embodiments and are not intended to limit the disclosure. Any modification, equivalent replacement and improvement made within the spirit and principle of the disclosure shall be included in the scope of protection of the disclosure.

What is claimed is:

1. A passage barrier comprising:

a substantially right-angled U-shaped frame having four corners, with each of the corners having an outer end, and the outer end having a mounting hole;

a gate being pivotally engaged in the frame;

a pressurized fastener corresponding to the mounting hole, the pressurized fastener comprising:

a screw, the screw having a head and a rod, the rod being slidably received in the mounting hole; and an adjustment member, the adjustment member having a through hole with an internal thread, the through hole being drilled on the rod and can be rotated around a rotation axis;

wherein the rod has a plurality of engaging parts and a plurality of non-engaging parts on an outer surface thereof, the engaging parts and the non-engaging parts being alternately connected, the engaging parts being located on a circumferential outer surface of the rod and having an external thread engaged with the internal thread, the engaging parts being located on a convex outer surface of the rod, the non-engaging parts being located within a circumferential surface of a virtual cylinder defined by the circumferential outer surface of the rod so as not to be engaged with the internal thread when the non-engaging parts extend through the through hole of the adjustment member;

wherein the external threads extend along a longitudinal axis of the rod a longer distance than the non-engaging parts; and wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

2. The passage barrier of claim 1, wherein at least one of the non-engaging parts is provided with an external thread which cannot be engaged with the adjustment member.

3. The passage barrier of claim 1, wherein at least one of the non-engaging parts is a flat surface or an arc surface.

4. The passage barrier of claim 3, wherein the arc surface is a convex arc surface or a concave arc surface.

5. The passage barrier of claim 1, wherein the number of the engaging parts and the non-engaging parts are two or three or four or five.

6. The passage barrier of claim 1, wherein the diving a dividing line between the engaging part and non-engaging part is located on the circumferential surface of the virtual cylinder.

7. A passage barrier comprising:

a substantially right-angled U-shaped frame having four corners, with each of the corners having an outer end, and the outer end having a mounting hole;

a gate being pivotally engaged in the frame;

a pressurized fastener corresponding to the mounting hole, the pressurized fastener comprising:

a screw, the screw having a head and a rod, the rod being slidably received in the mounting hole; and an adjustment member, the adjustment member having a through hole with an internal thread, the through hole being drilled on the rod and rotatable around a rotation axis;

wherein the rod has two engaging parts and two non-engaging parts on an outer surface thereof, the engaging parts being located on a convex outer surface of the rod, the engaging parts and the non-engaging parts being alternately connected and their dividing lines being located on a circumferential surface of a virtual cylinder defined by a circumferential outer surface of the rod with the rotation axis as cylinder axis, the engaging parts being located on the circumferential outer surface and having an external thread engaged with the internal thread, the non-engaging parts being located within the circumferential surface of the virtual cylinder so as not to be engaged with the internal thread when the non-engaging parts extend through the through hole of the adjustment member, and the non-engaging parts are two opposite sides of a quadrangular prism with the dividing lines as edges;

wherein the external threads extend along a longitudinal axis of the rod a longer distance than the non-engaging parts; and wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

8. The passage barrier of claim 7, wherein the quadrangular prism is a regular quadrangular prism or a straight prism with a trapezoidal bottom surface.

9. The passage barrier of claim 8, wherein the two non-engaging parts are two sides corresponding to the two waists of the trapezoid or two sides corresponding to the upper and lower bottoms of the trapezoid.

10. A passage barrier comprising:

a substantially right-angled U-shaped frame having four corners, with each of the corners having an outer end, and the outer end having a mounting hole;

a gate being pivotally engaged in the frame;

a pressurized fastener corresponding to the mounting hole, the pressurized fastener comprising:

a screw, the screw having a head and a rod, the rod being slidably received in the mounting hole; and an adjustment member, the adjustment member having a through hole with an internal thread, the through hole being drilled on the rod and can be rotated around a rotation axis;

wherein the rod has as engaging part and a non-engaging part on an outer surface thereof, the engaging parts being located on a convex outer surface of the rod, the engaging part and the non-engaging part being connected and their dividing lines being located on a circumferential surface of a virtual cylinder defined by a circumferential outer surface of the rod with the rotation axis as cylinder axis, the engaging part being located on the circumferential outer surface corresponding to a major arc of the virtual cylinder and having an external thread engaged with the internal thread, the non-engaging part being located within the circumferential surface of the virtual cylinder so as not to be engaged with the internal thread when the non-engaging part extends through the through hole of the adjustment member;

wherein the external threads extend along a longitudinal axis of the rod a longer distance than the non-engaging parts; and wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

11. The passage barrier of claim 10, wherein the non-engaging part is a flat surface or a curved surface.

12. The passage barrier of claim 11, wherein the arc surface is a convex arc surface or a concave arc surface.

13. A passage barrier comprising:

a substantially right-angled U-shaped frame having four corners, with each of the corners having an outer end, and the outer end having a mounting hole;

a gate being pivotally engaged in the frame;

a pressurized fastener corresponding to the mounting hole, the pressurized fastener comprising:

a screw, the screw having a head and a rod, the rod being slidably received in the mounting hole; and an adjustment member, the adjustment member having a through hole with an internal thread, the through hole being drilled on the rod and can be rotated around a rotation axis;

wherein the rod has a plurality of engaging threaded parts and a plurality of non-engaging threaded parts on an outer surface thereof, the engaging threaded parts and the non-engaging threaded parts being alternately and substantially smoothly connected and their threads are continuous and their dividing lines located on a circumferential surface of a virtual cylinder defined by an outer circumferential surface of the rod with the rotation axis as cylinder axis, the engaging threaded parts being located on a convex portion of the outer circumferential surface of the rod and having an external thread engaged with the internal thread, the non-engaging threaded parts being located within the circumferential surface of the virtual cylinder so as not to be engaged with the internal thread when the non-engaging parts extend through the through hole of the adjustment member;

wherein the external threads extend along a longitudinal axis of the rod a longer distance than the non-engaging parts; and wherein a cross-sectional shape of the mounting hole is substantially the same as a cross-sectional shape of the rod, and the cross-sectional size of the mounting hole is slightly larger than the cross-sectional size of the rod, so that the rod can only be slid in the mounting hole and cannot be rotated.

14. The passage barrier of claim 13, wherein the engaging threaded parts are annularly arrayed on the circumferential surface of the virtual cylinder.

15. The passage barrier of claim 13, wherein the number of the engaging threaded parts and the non-engaging threaded parts are either three or four.

16. A passage barrier comprising:

a substantially right-angled U-shaped frame having four corners, with each of the corners having an outer end, and the outer end having a mounting hole;

a gate being pivotally engaged in the frame;

a pressurized fastener corresponding to the mounting hole, the pressurized fastener comprising:

a screw, the screw having a head and a rod, the rod being slidably received in the mounting hole; and an adjustment member, the adjustment member having a through hole with an internal thread, the through hole being drilled on the rod and can be rotated around a rotation axis;

wherein the rod has an engaging part and a non-engaging part on an outer surface thereof, the engaging part being located on a circumferential outer surface of the rod and having an external thread engaged with the internal thread, the engaging part being located on a convex outer portion of the rod, wherein the adjustment member is rotatable on the rod without substantially shaking, the non-engaging part being located within a circumferential surface of a virtual cylinder defined by the outer surface of the rod, so as not to be engaged with the internal thread when the non-engaging part extends through the through hole of the adjustment member;

wherein the external thread extends along a longitudinal axis of the rod a longer distance than the non-engaging parts; and wherein a cross-sectional shape of the mounting hole being substantially the same as a cross-sectional shape of the rod, and the cross-sectional size of the mounting hole being slightly larger than the cross-sectional size of the rod, so that the rod can only be slid in the mounting hole and cannot be rotated.

17. The passage barrier of claim 16, wherein the non-engaging part has an external thread that cannot be engaged with the adjusting member.

18. The passage barrier of claim 16, wherein the non-engaging part is a flat surface or an arc surface.

* * * * *